US010464736B1

(12) United States Patent
Pindor et al.

(10) Patent No.: US 10,464,736 B1
(45) Date of Patent: Nov. 5, 2019

(54) SPRAY CAN ACTUATOR

(71) Applicants: Randy M. Pindor, Brecksville, OH (US); Theodore Bradley, North Ridgeville, OH (US); Gregory L. Skillicorn, Akron, OH (US)

(72) Inventors: Randy M. Pindor, Brecksville, OH (US); Theodore Bradley, North Ridgeville, OH (US); Gregory L. Skillicorn, Akron, OH (US)

(73) Assignee: The B'Laster Corporation, Valley View, OH (US)

( * ) Notice: Subject to any disclaimer, the term of this patent is extended or adjusted under 35 U.S.C. 154(b) by 0 days.

(21) Appl. No.: 16/138,576

(22) Filed: Sep. 21, 2018

Related U.S. Application Data

(60) Provisional application No. 62/561,521, filed on Sep. 21, 2017.

(51) Int. Cl.

| | |
|---|---|
| ***B65D 83/20*** | (2006.01) |
| ***B65D 83/22*** | (2006.01) |
| ***B65D 83/24*** | (2006.01) |
| ***B65D 83/30*** | (2006.01) |
| ***B65D 50/04*** | (2006.01) |
| ***B05B 11/00*** | (2006.01) |

(52) U.S. Cl.
CPC ..... *B65D 83/303* (2013.01); *B65D 83/205* (2013.01)

(58) Field of Classification Search
USPC ..... 222/402.13, 402.17; 239/333
See application file for complete search history.

(56) References Cited

U.S. PATENT DOCUMENTS

| | | | | |
|---|---|---|---|---|
| 3,083,872 | A * | 4/1963 | Meshberg | B05B 1/1645 116/319 |
| 4,690,312 | A * | 9/1987 | Crapser | B05B 1/1645 222/402.17 |
| 5,154,323 | A | 10/1992 | Query et al. | |
| D358,989 | S * | 6/1995 | Woods | D23/213 |
| 6,105,882 | A * | 8/2000 | Woltjen | B05B 1/1654 239/390 |
| 6,293,436 | B2 | 9/2001 | Faughnder et al. | |
| 6,796,464 | B1 * | 9/2004 | Tung | B65D 47/305 222/402.13 |
| 7,070,072 | B2 * | 7/2006 | Bonham | B65D 83/303 222/402.1 |

(Continued)

*Primary Examiner* — Paul R Durand
*Assistant Examiner* — Andrew P Bainbridge

(57) ABSTRACT

An actuator for a spray can. The actuator includes a housing for attachment to an aerosol can covering a stem valve. A finger operating button structure is engaged with the housing for engaging the stem valve. A rotary two-way diverter valve is supported within the housing and rotatably engaged with the finger operating button structure. In a spray position/straw down, the two-way diverter valve directs spray through a first direct spray nozzle. In a second straw position/straw up, to make use of an adjustable straw, the diverter valve is rotated to engage a straw spray passage of the diverter valve in fluid communication with an adjustable rotary spray tip and engaged straw. By rotating the adjustable rotary spray tip to an aligned position, the tip substantially blocks the straw spray passage to provide a drip mode, where drops of fluid exit the straw. A flexible tip may optionally be provided on the straw to enable bending and retention of the flexible tip to a desired position.

5 Claims, 14 Drawing Sheets

(56) References Cited

U.S. PATENT DOCUMENTS

| | | | | |
|---|---|---|---|---|
| D536,970 | S * | 2/2007 | Shannan | D9/448 |
| 8,353,465 | B2 * | 1/2013 | Tryon | B05B 1/1654 239/11 |
| D691,040 | S | 10/2013 | Wade et al. | |
| D723,368 | S | 3/2015 | Checklin et al. | |
| 9,248,457 | B2 * | 2/2016 | Hanson | B05B 1/30 |
| 9,352,896 | B2 * | 5/2016 | Deutsch | B05B 14/00 |
| 10,065,791 | B1 * | 9/2018 | Charles | B65D 83/306 |
| 2002/0053579 | A1 * | 5/2002 | Baumgart | B65D 83/206 222/527 |
| 2004/0164105 | A1 | 8/2004 | Stern | |
| 2005/0173465 | A1 | 8/2005 | Roden | |
| 2017/0203908 | A1 | 7/2017 | Sater et al. | |
| 2019/0077580 | A1 * | 3/2019 | Starzman | B05B 1/1645 |

* cited by examiner

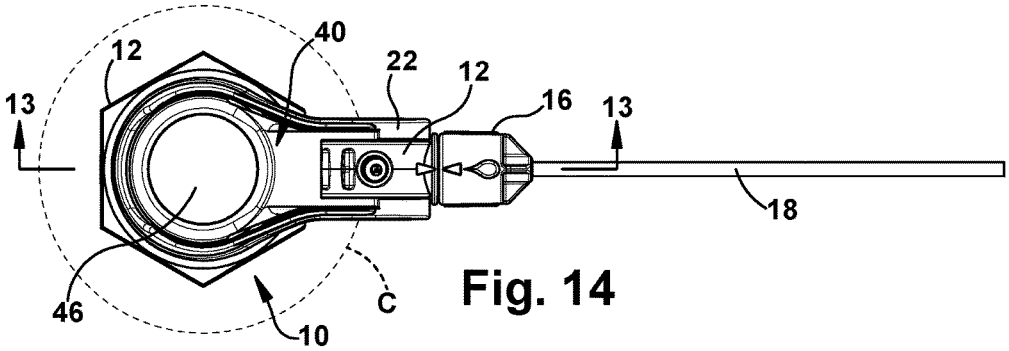
Fig. 14
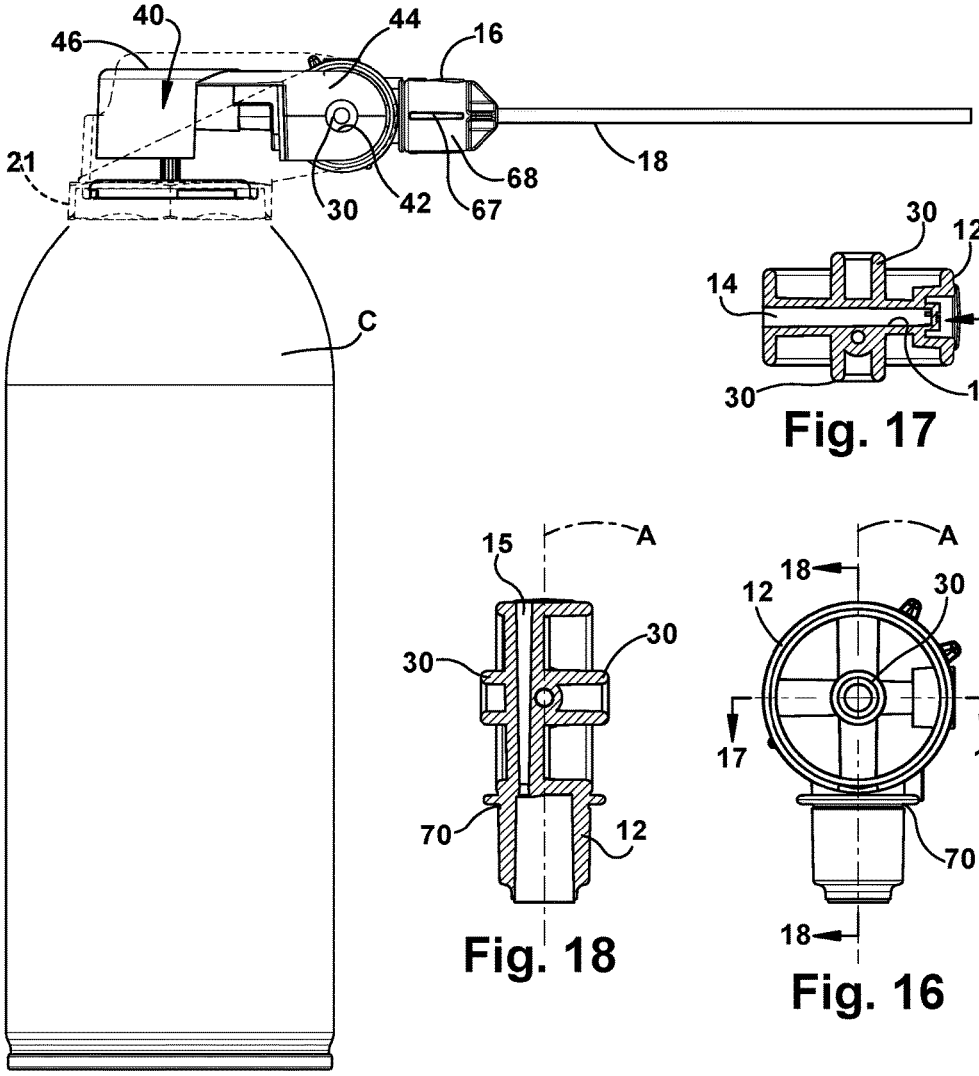
Fig. 15
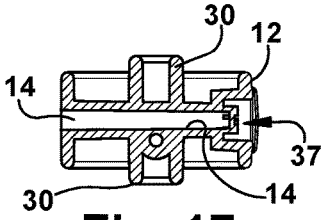
Fig. 17
Fig. 18
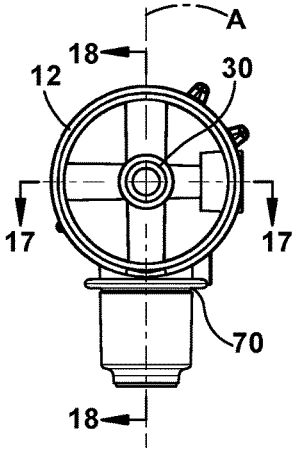
Fig. 16

SPRAY CAN ACTUATOR

CROSS REFERENCE TO RELATED APPLICATION

This application claims priority to and the benefit of U.S. Patent Application No. 62/561,521 filed Sep. 21, 2017, the entire contents of which are incorporated herein by reference.

FIELD OF INVENTION

The application relates to an actuator for a spray can having a rotary two-way diverter valve with a straw, and specifically to an adjustable rotary two-way diverter valve with a direct spray nozzle and an adjustable straw for directing a desired spray or drip to a desired location.

BACKGROUND

Adjustable actuators for aerosol spray cans have become desirable to consumers for their aerosol products. Historically, and today, spray can actuators typically include a single finger operated spray button mounted on the aerosol can discharge valve. For certain consumer aerosol products, such as chemical penetrants, lubricants and rust inhibitors, for example, consumers desire an actuator which provides both a direct spray, stream or drip, and the ability to apply the product to a precise location from a further distance and perhaps within a somewhat obscured location. Using a removable, stand-alone straw in connection with the spray button enabled direct product application from a distance, but storage of the straw for later applications and use was problematic, often resulting in the loss of the straw. Some improvements have been provided, as set forth in U.S. Pat. Nos. 9,352,896, D536,970 and D723,368. However, additional improvements to provide still further aerosol spray application alternatives are desired.

SUMMARY

An improved actuator for an aerosol spray can is provided which has an adjustable rotary two-way diverter valve, with a nozzle providing a direct spray, such as a conical fan spray pattern, and an adjustable rotary spray tip having a removable straw, or an optional straw with a flexible tip, for directing a desired straw spray in a spray position, or liquid drops to a desired location in a drip position. The improved actuator includes a housing for attachment on the top of an aerosol can covering the aerosol can discharge valve or valve stem. The housing includes mounting legs forming an opening for rotating engagement with the two-way rotary diverter valve having integral boss axles mounted within axle openings formed in mounting legs of a finger operating dispensing button structure. The finger operating dispensing button structure is slidably engaged within the housing for finger operation of a button by a user to depress the spray can discharge valve. The finger operating structure includes a nozzle passage extending transversely from a central vertical conically shaped passage engaging the valve stem. A nozzle end of the nozzle passage engages the rotary diverter valve, which is captured within the button structure and the housing, at an o-ring seal.

In operation, the two-way diverter valve may be rotated between a full spray position/straw down, to a straw position/straw up. Rotation of the two-way diverter valve may be operated into and out of the full spray position and straw position with one hand or finger. The external surface of the diverter valve is preferably provided with features, such as a textured surface or more protruding features such as ribs or raised boss portions ("nibs"), since such features assist with overcoming the amount of finger force required to rotate the diverter valve while maintaining a seal, provided by the o-ring seal, between the diverter valve and the dispensing button structure. In the full spray position/straw down, finger operation to depress the dispensing button structure, causes fluid to exit the can via the valve stem, through the central vertical conical passage and nozzle passage within the button structure, past the o-ring into a nozzle passage of the diverter valve.

In the straw up position, the adjustable rotary spray tip may be adjusted to either the spray position or the drip position. In the straw spray position/straw up, the two-way diverter valve is first rotated upward, so that the nozzle end of the nozzle passage of the finger operating button structure, engages the diverter valve at an alternate straw nozzle passage within the diverter valve, offset from a central axis of the valve. In straw spray position/straw up, fluid exits the can via the valve stem upon depression of the dispensing button structure, through the central vertical conical passage and nozzle passage within the button structure, past the o-ring into a straw spray passage of the diverter valve in fluid communication with the adjustable rotary spray tip and straw. In straw drip position/straw up, the adjustable rotary spray tip is rotated to align indicia on the outer surface of the tip with indicia on the outer surface of the diverter valve. In this aligned position, a post adjacent the straw spray passage of the diverter valve substantially, but not fully, blocks fluid flow to the tip and straw. Sufficient pressure from the aerosol spray can (typically at 90 psi), together with residual fluid within the passage, continues to permit a small amount of fluid to exit the straw as drops, not as a spray.

DESCRIPTION OF THE DRAWINGS

FIG. 14 is a top partial phantom view of the spray can actuator of this application in straw up position.

FIG. 15 is a side partial phantom view of the spray can actuator of FIG. 14.

FIG. 16 is a right side view of the two-way diverter valve of the spray can actuator of this application.

FIG. 17 is a cut-away view of the two-way diverter valve taken along the line G-G of FIG. 16.

FIG. 18 is a cut-away view of the two-way diverter valve taken along the line H-H of FIG. 16.

DETAILED DESCRIPTION

Figure 1:
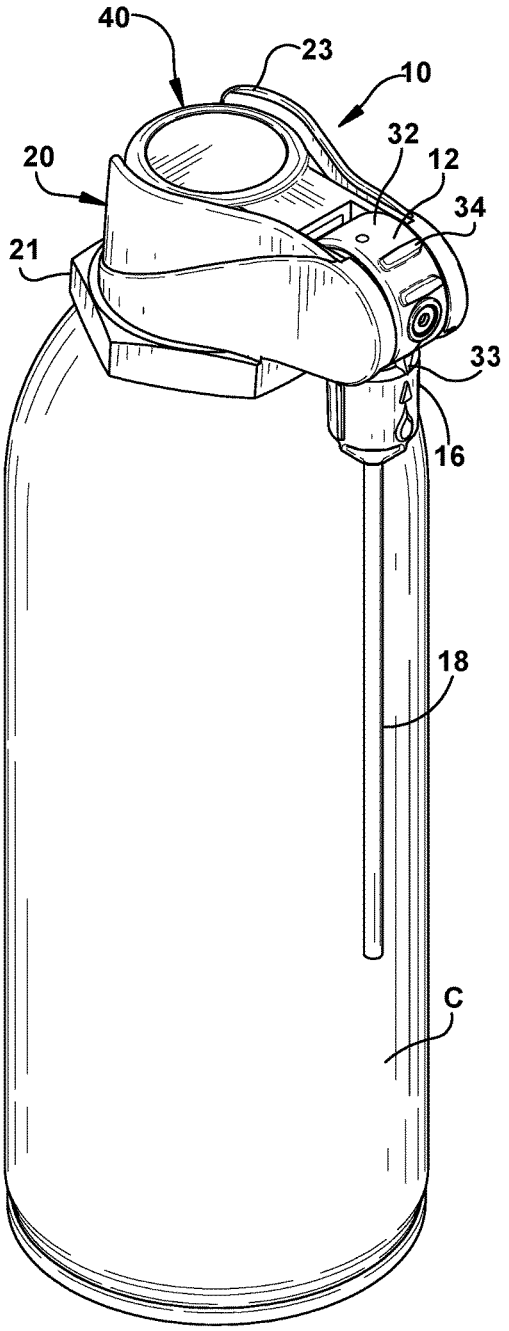
FIG. 1 is a bird's eye right side perspective view of the spray can actuator of this application.
Figure 2:
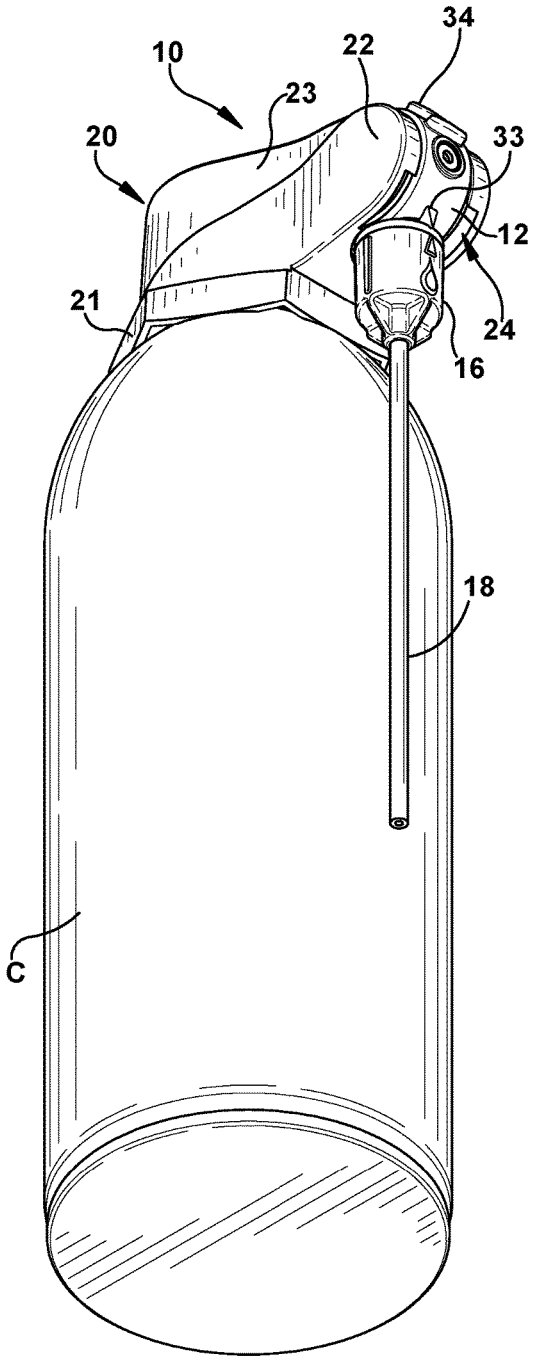
FIG. 2 is an ant's eye right side perspective view of the spray can actuator of FIG. 1.
Figure 3:
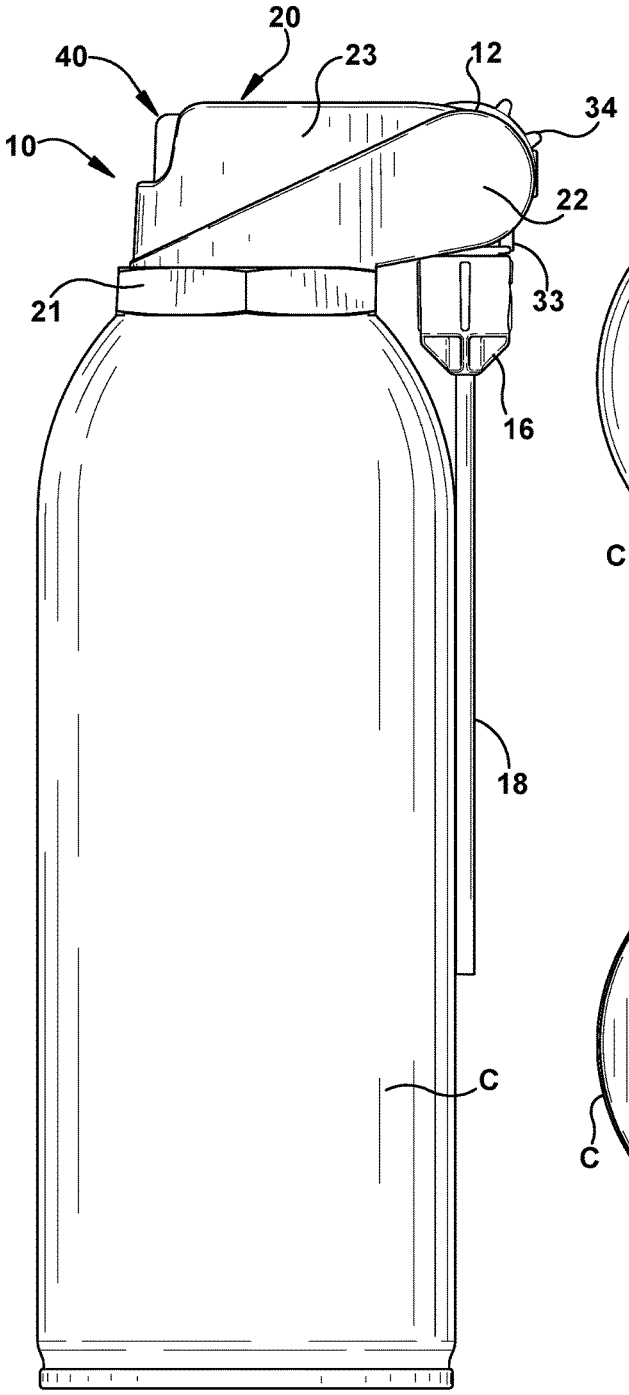
FIG. 3 is a side view of the spray can actuator of FIG. 1.
Figure 4:
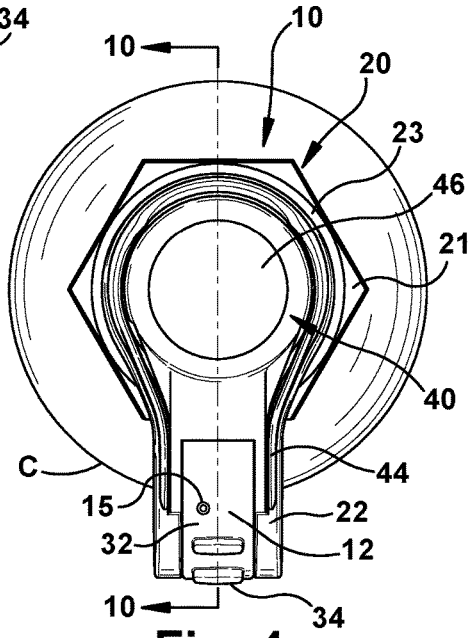
FIG. 4 is a top view of the spray can actuator of FIG. 3.
Figure 5:
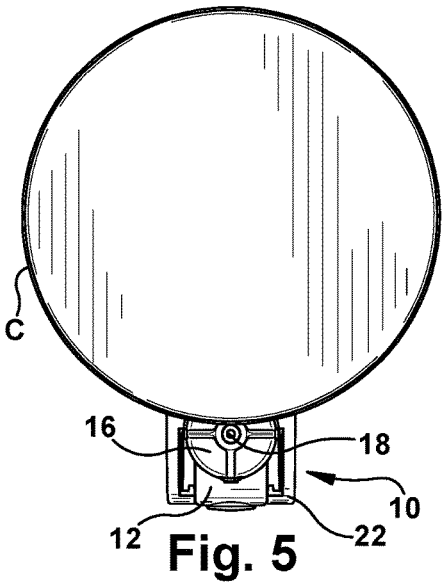
FIG. 5 is a bottom view of the spray can actuator of FIG. 3.
Figure 6:
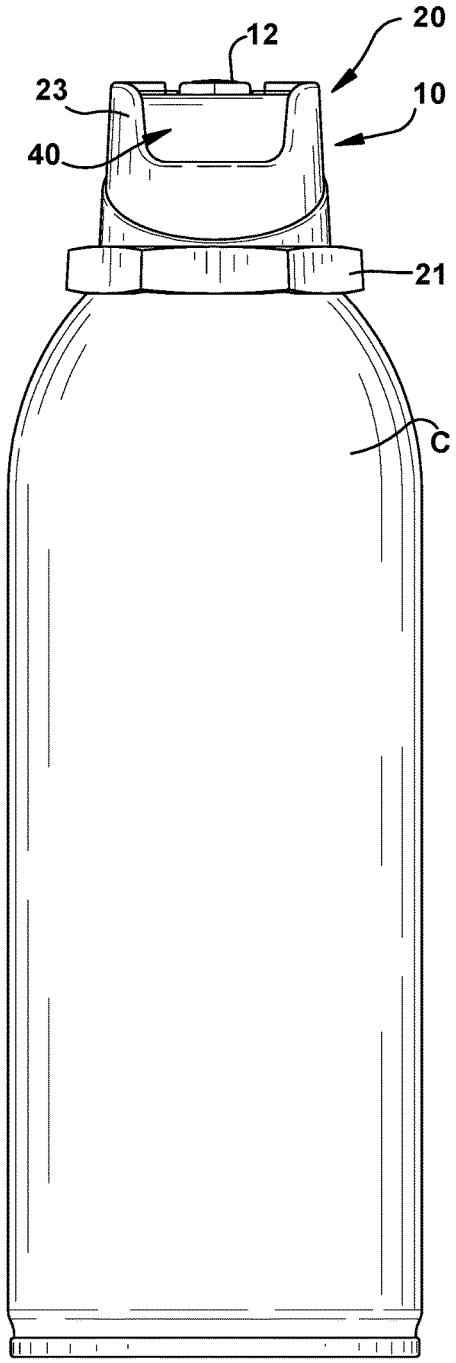
FIG. 6 is a rear view of the spray can actuator of FIG. 1.
Figure 7:
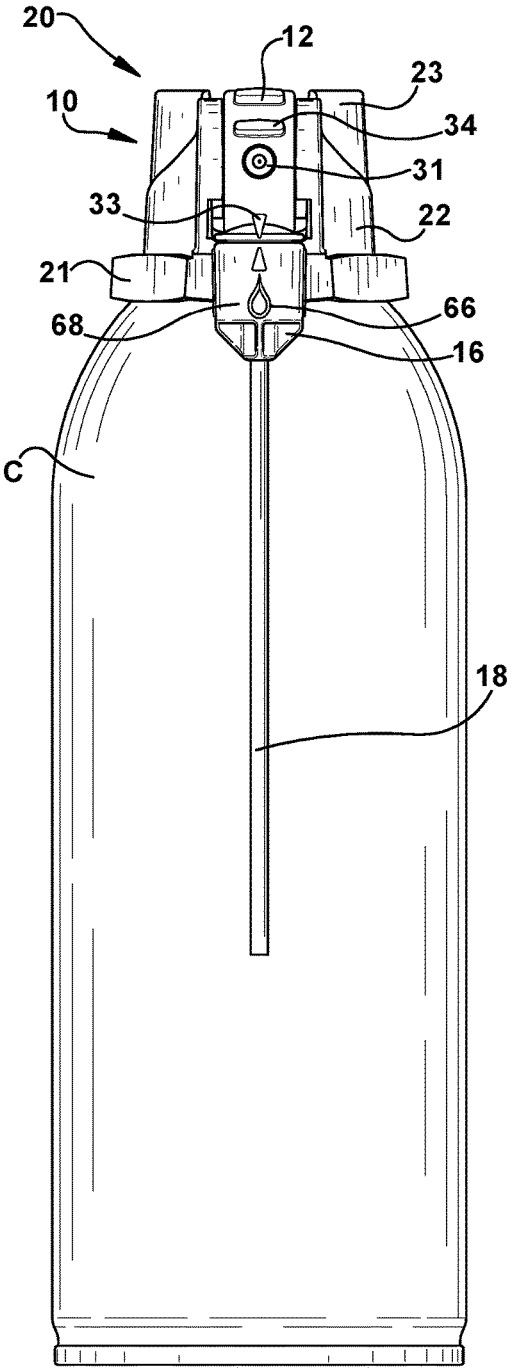
FIG. 7 is a front view of the spray can actuator of FIG. 1.
Figure 8:
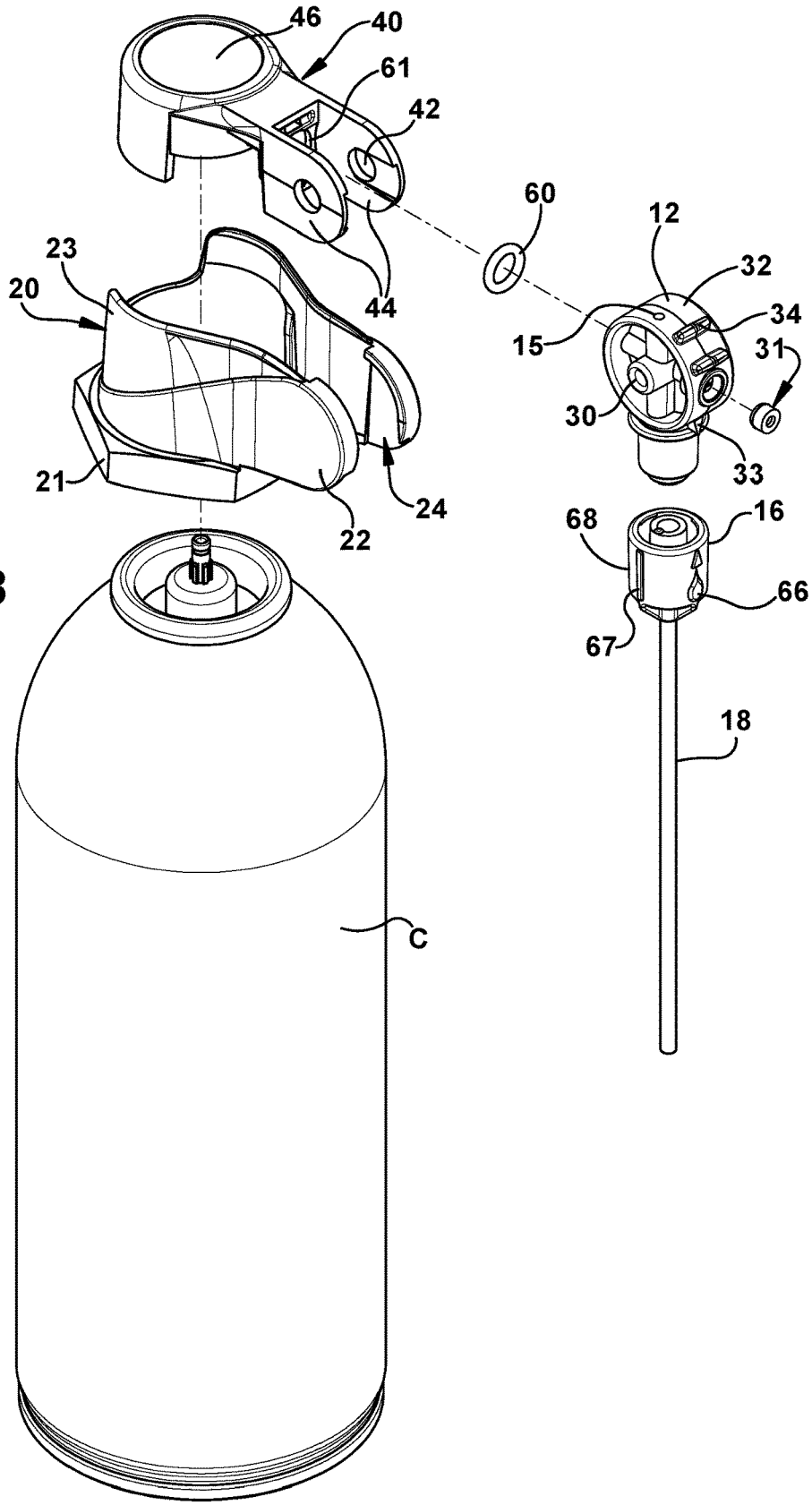
FIG. 8 is an exploded right side perspective view of the components of the spray can actuator of FIG. 1.
Figure 9:
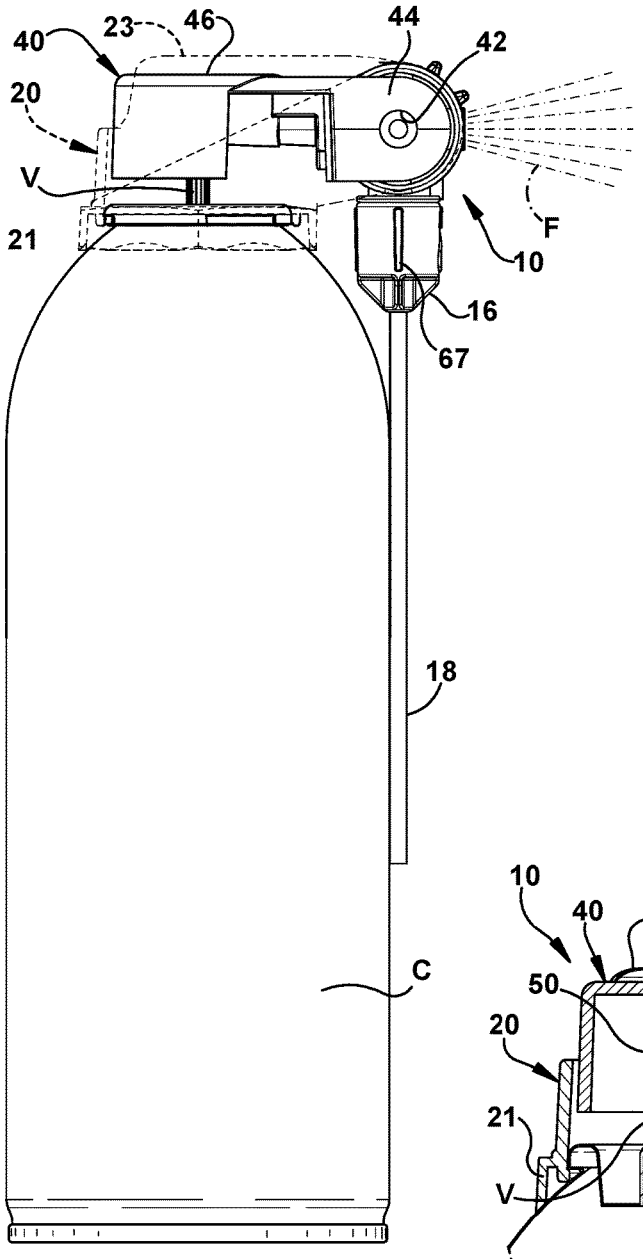
FIG. 9 is a partial phantom view showing the button structure and diverter valve of the spray can actuator in spray position, within a phantom housing.
Figure 22:
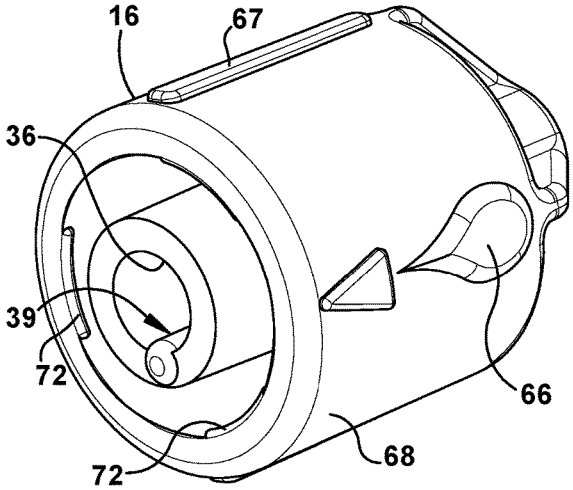
FIG. 22 is an enlarged, rear, right side, perspective view of the adjustable rotary spray tip.
Figure 24:
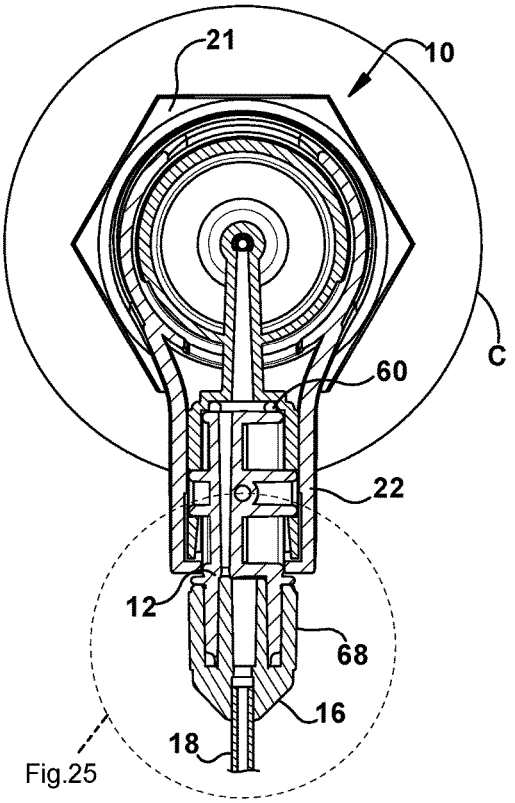
FIG. 24 is a cut-away top view taken along the line 24-24 of FIG. 23, and showing the fluid passage in the straw up position/drip position.
Figure 25:
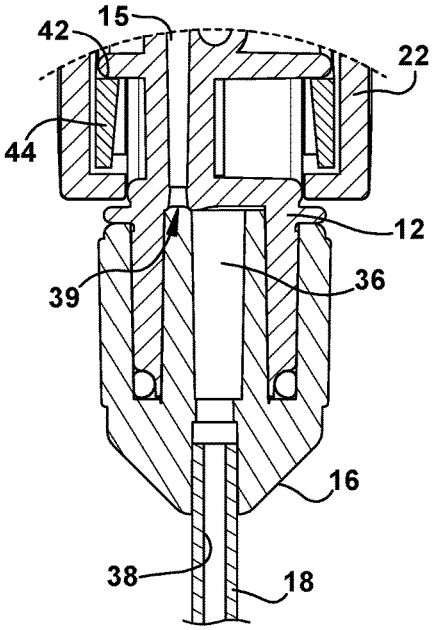
FIG. 25 is an enlarged view taken from the indicated section of FIG. 24.
Figure 23:
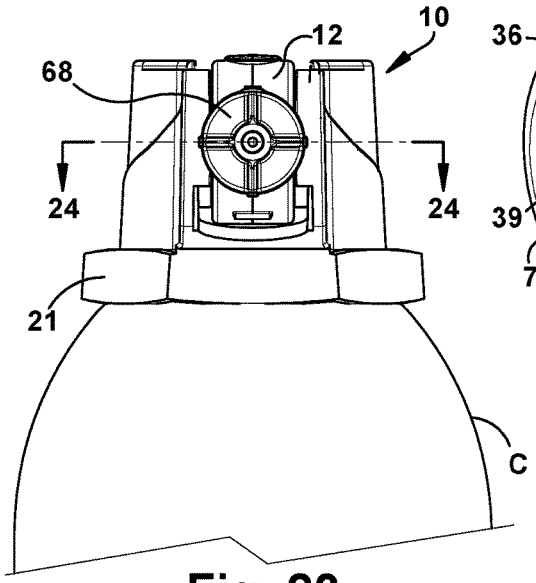
FIG. 23 is a front partial phantom view of the spray can actuator of FIG. 14 in the straw up position/drip position.
Figure 26:
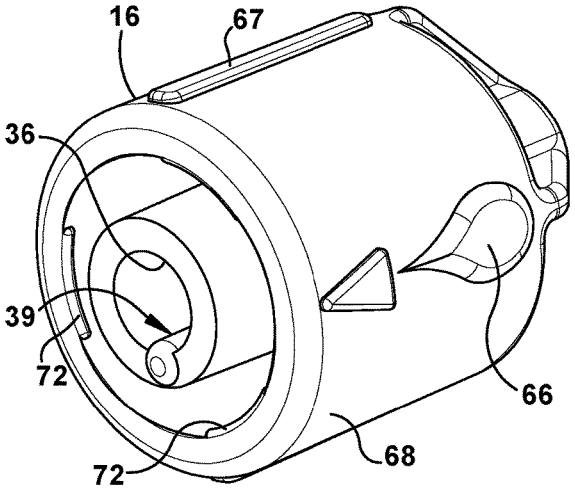
FIG. 26 is an enlarged, rear, right side, perspective view of the adjustable rotary spray tip.

As shown in FIGS. 1 to 7, the improved actuator 10 for an aerosol spray can C of the present application is provided. As best seen in FIG. 8, the actuator 10 includes an adjustable rotary two-way diverter valve 12. The diverter valve 12 has a nozzle 14 for providing a direct spray, such as a conical fan spray pattern, shown in FIG. 9, and a second straw nozzle 15 for communication with an adjustable rotary spray tip 16. The tip 16 is adapted for engagement by a removable straw 18, preferably a flexible straw. When adjusted to a first spray position, shown in FIGS. 14 and 19-21, the diverter valve and 12 and adjustable rotary spray tip 16 enable a spray of liquid to be directed through the straw 18. When adjusted to a second drip position, as shown in FIGS. 23-25, the diverter valve 12 and adjustable rotary spray tip enable liquid drops to be applied a desired location. As shown in the alternate embodiments of FIGS. 27 to 40, an optional straw may alternatively be provided, which includes an adjustable, flexible tip 19. It is noted that where the features of the alternate embodiments of FIGS. 27 to 40 are similar to those of the embodiment of FIGS. 1 to 26, the same reference numerals will be used, but with a prime designation.

FIG. 8 illustrates the housing 20 for attachment over the aerosol can valve stem V. The housing 20 includes a hex base 21 which is engaged, or snapped, over can C top components T and retained by spaced tabs 25 extending inwardly from the hex base as shown in FIGS. 12-15 and 20-24. Mounting legs 22 extend upward and away from the hex base 21, out of the footprint of the can C, to form an opening 24 for rotating engagement by the diverter valve 12, which is captured within the mounting legs 22 and the finger operating dispensing button structure 40. The button structure 40 is vertically, slidably engaged, and captured within the housing 20 for finger operation by a user of a button 46, which depresses the spray can valve stem V. An integral apron 23 extends upward from the one-piece hex base 21 and mounting legs 22, to substantially surround and extend above the finger operating button structure 40, as illustrated in FIGS. 3, 6, 9-13 and 15. The extension of the apron 23 above the surface of the button 46, assists with avoiding accidental depression of the button 46 to spray fluid during storage or shipment of the spray can. The housing is preferably manufactured of polyethylene or other equivalent polymer material.

Figure 10:
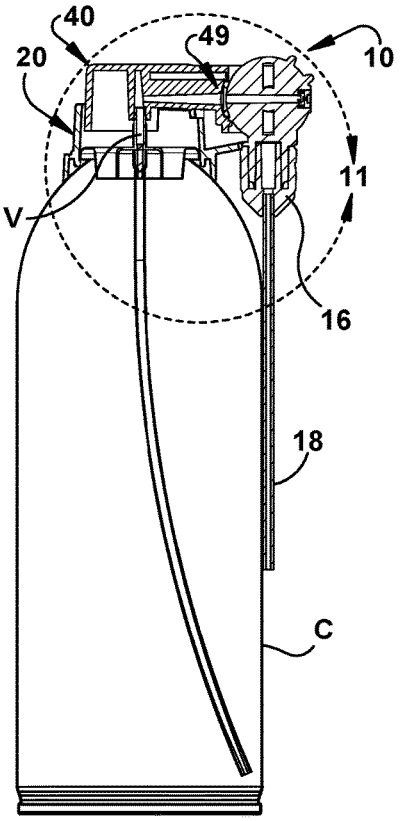
FIG. 10 is a cut-away view taken along the line 10-10 of FIG. 4, showing the valve stem and internal dispensing tube of the spray can.
Figure 11:
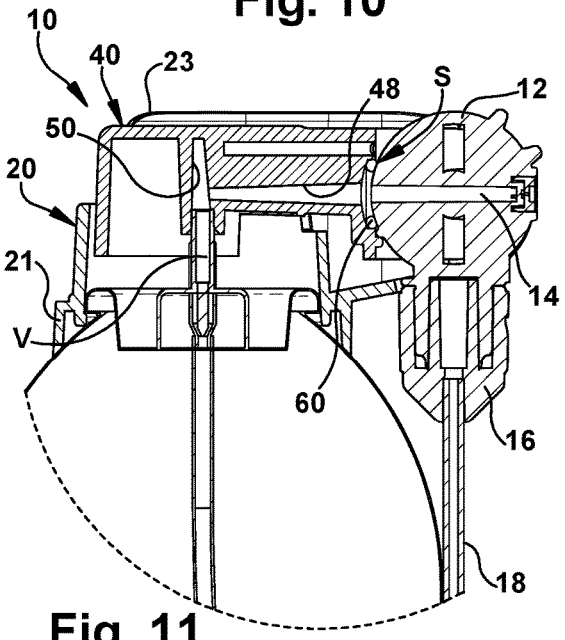
FIG. 11 is an enlarged view taken from the portion indicated at 11 of FIG. 10.
Figure 12:
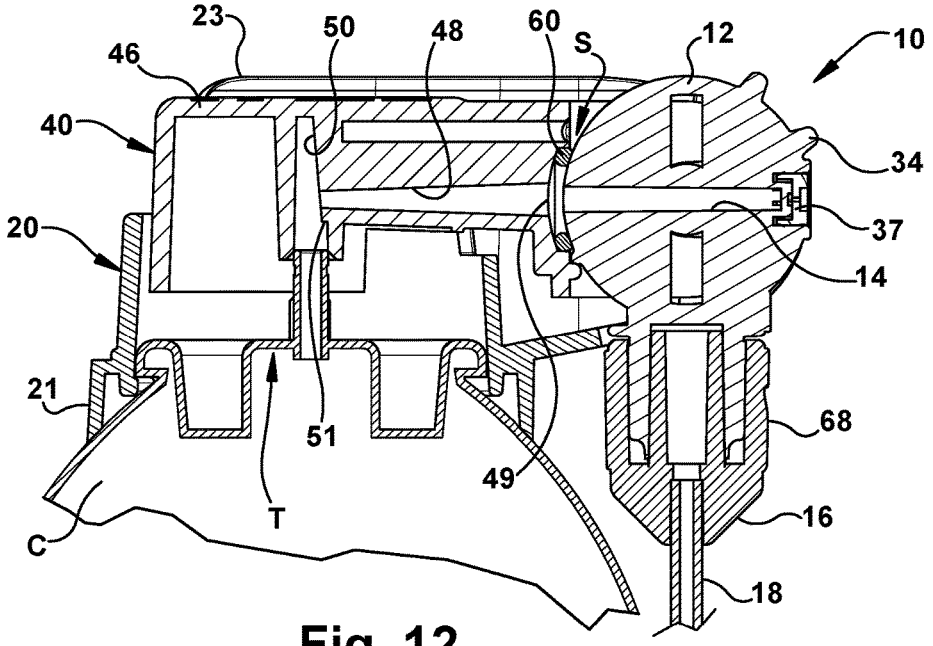
FIG. 12 is an enlarged cut-away view of the spray can actuator taken along the line 10-10 of FIG. 4, but with the valve stem and internal dispensing tube of the spray can removed.
Figure 13:
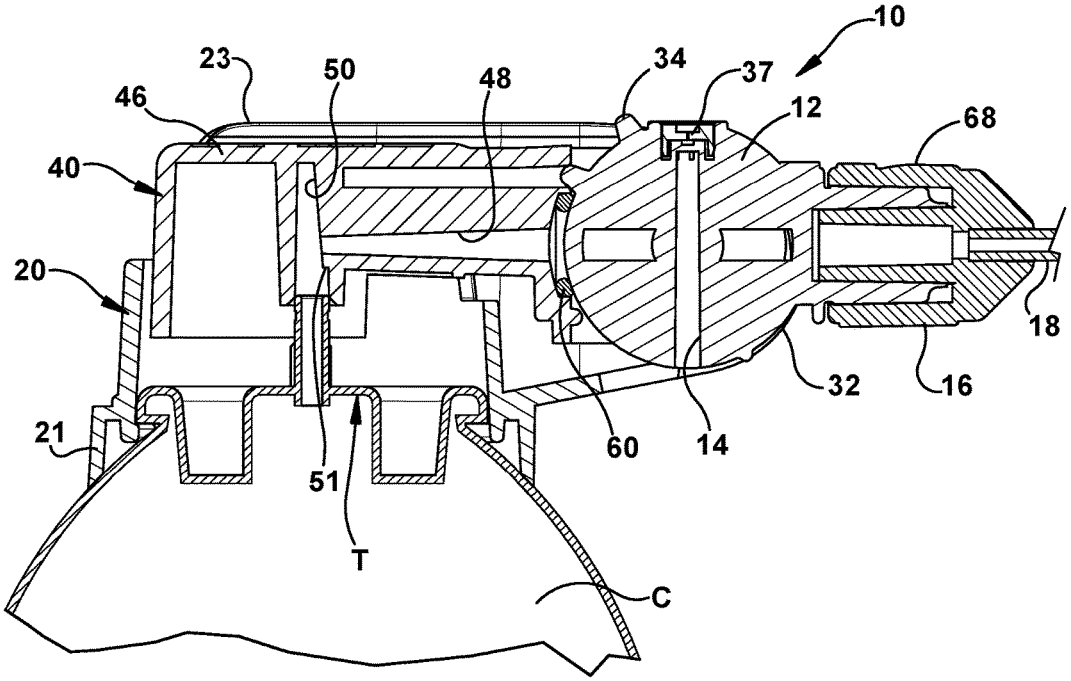
FIG. 13 is an enlarged cut-away view taken along the 13-13 of the spray can actuator of FIG. 14.

The button structure 40 includes an internal nozzle passage 48. In FIGS. 10 and 11 the button structure 40 is shown engaged with the can and valve stem V. In FIGS. 12-13, additional internal aspects of the passages within the button structure 40 are seen where the can C components are shown, but valve stem V is not depicted. The nozzle passage 48 extends transversely from a central vertical conically shaped passage 50. Within the vertical passage 50, a stop 51 is provided to engage and depress the valve stem V downwardly when a user depresses the button 46 of the button structure 40, to release fluid F from the spray can C via the desired fluid path P selected by the user. A nozzle end 49 of the nozzle passage 48 is positioned immediately adjacent the rotary diverter valve 12. The diverter valve 12 is engaged with and captured within the button structure 40 and the housing 20, at an o-ring 60, which is seated within a groove 61 in the button structure 40, to form a seal S. The button structure 40 is preferably manufactured of polyethylene, high density polyethylene or other equivalent polymer material.

To obtain fluid F from the spray can C, the two-way diverter valve 12 is adapted for rotation by the user to the position where fluid will be dispensed from the desired location of the spray can actuator 10. Three modes of operation are preferably provided. For the full spray position, the straw is rotated to a down position, as in FIGS. 1-12. For the straw spray position, the straw is rotated to an up position, as in FIGS. 13-15, and the adjustable rotary spray tip 16 is rotated to a position which does not align (as in FIG. 14) with a drip indicia 66 provided on an outer surface 68 of the spray tip 16, with an alignment mark 33 on the diverter valve 12. For the straw drip position, the straw is in the up position, as in FIGS. 23-25, and the adjustable rotary spray tip 16 is rotated to a position which aligns the drip indicia 66 with the alignment mark 33. The two-way diverter valve 12 is adapted for rotation by the user with one hand or preferably one finger. The diverter valve 12 and spray tip 16 are preferably manufactured of polyethylene, high density polyethylene or other equivalent polymer material.

The two-way rotary diverter valve 12 is best illustrated in FIGS. 8 and 16-18. The diverter valve 12 includes integral boss axles 30. The axles 30 are mounted for rotation within axle openings 42 formed in the mounting legs 44 of the button structure 40, which are captured within the legs 22 and opening 24 of the housing 20. The external surface 32 of the diverter valve 12 is preferably provided with features such as a textured surface, for example the ribs or grooves 34 shown in the embodiment of FIGS. 27 to 39, or protruding features such as ribs, in FIG. 40, or raised boss portions ("nibs") in FIG. 1. These surface features assist the user to overcome the finger force required to rotate the diverter valve 12 while maintaining the seal S, provided by the o-ring 60 between the diverter valve 12 and the button structure 40.

Following the fluid path exiting the spray can C in spray position/straw down (FIG. 9): As the button 46 is depressed, and the valve stem V engages the stop 51, fluid F exits the can via the valve stem to the central vertical conical passage 50, to nozzle passage 48 past nozzle end 49 and the o-ring 60, within groove 61, into the nozzle 14 and an exit nozzle 37 in the diverter valve 12. A spray tip 31 is engaged, by a snap fit or press fit, into engagement over the exit nozzle 37, as shown in FIGS. 11-13.

Figure 20:
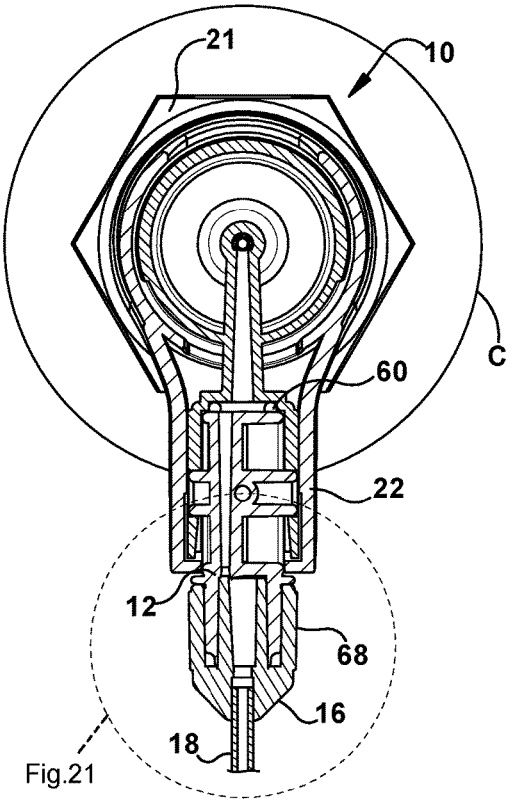
FIG. 20 is a cut-away top view taken along the line 20-20 of FIG. 19, and showing the fluid passage in the straw up position/spray or non-drip position.
Figure 21:
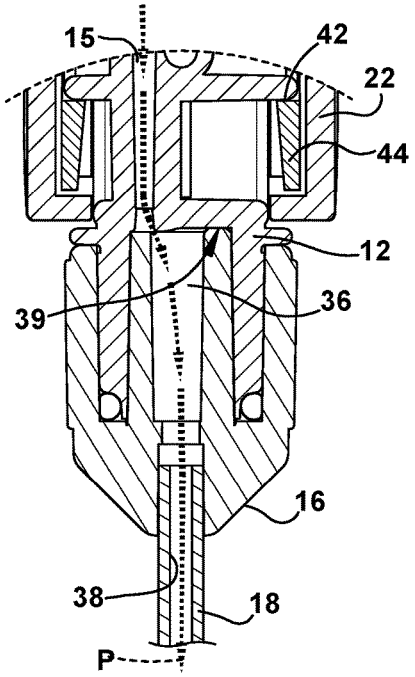
FIG. 21 is an enlarged view taken from the indicated section of FIG. 20.
Figure 19:
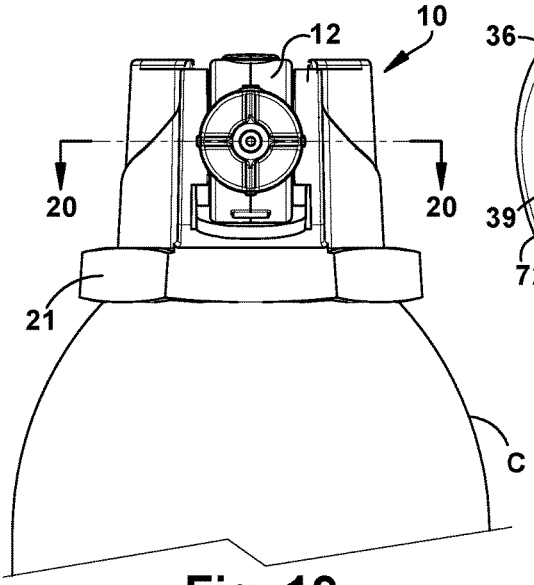
FIG. 19 is a front partial phantom view of the spray can actuator of FIG. 14 in the straw up position/spray or non-drip position.

Following the fluid path exiting the spray can C in straw up position, the adjustable rotary spray tip 16 is adjusted by the user to either the spray position or the drip position. The spray tip 16 is engaged, or snapped into a groove 70 within the diverter valve 12, and retained for rotation within the groove by spaced tabs 72, which extend inwardly from the spray tip 16 as shown in FIGS. 13 and 22. For straw spray position, the spray tip 16 is rotated to align the alignment mark 33 on the diverter valve with any non-drip indicia 67 on the external surface of the spray tip 16. In the straw spray position, the two-way diverter valve 16 is rotated upward until a nib 34 engages an opening in the button structure 40, as shown in FIG. 13, to stop movement of the valve. In this position, the fluid path is blocked from the nozzle 14. Instead, as shown in FIGS. 20-21, once the button 46 is depressed, fluid exits the can C via the valve stem V, vertical conical passage 50 and nozzle passage 48, past the o-ring 60 and groove 61, to the straw nozzle 15, which is offset from the central axis A, and in fluid communication with the adjustable rotary spray tip 16 to a tip nozzle 36 and straw passage 38 in straw 18, which is press fit or otherwise secured into the spray tip 16.

Following the fluid path in straw drip position, the adjustable rotary spray tip 16 is rotated to align the drip indicia 66 on the outer surface 68 of the spray tip 16 with the alignment mark 33 on the diverter valve 12. In this aligned position, a post 39 formed within the spray tip 16 is moved to a position adjacent and substantially blocking the straw nozzle passage 15, as indicated in FIG. 25. In this position, the post 39 prevents the spray of fluid from the tip 16, and substantially blocks nearly all fluid flow to the tip and straw. However, sufficient pressure from the pressurized aerosol spray can when the button 46 is depressed, together with residual fluid in the fluid path, permits a small amount of fluid to exit the straw as drops.

Figure 27:
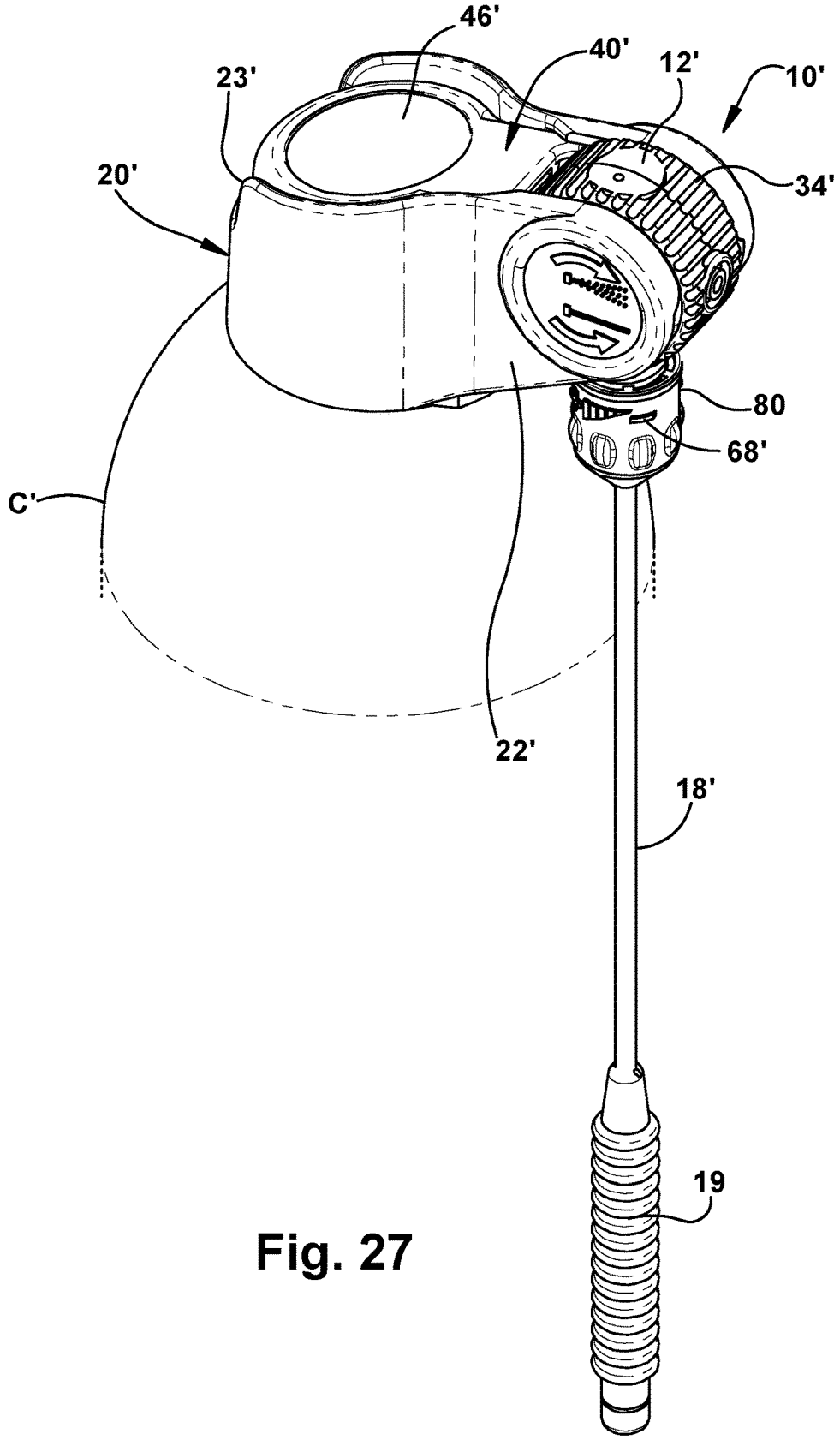
FIG. 27 is an alternate embodiment of the spray can actuator of this application.
Figure 28:
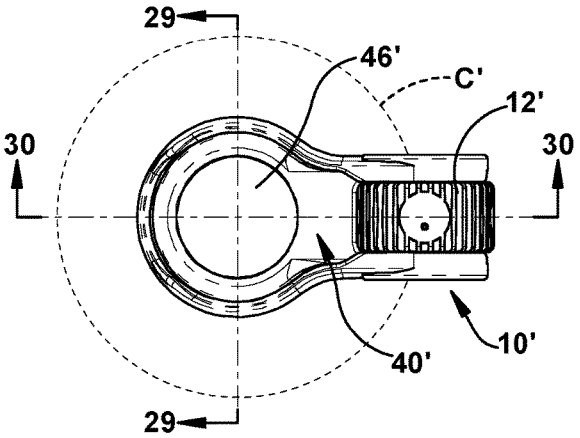
FIG. 28 is a top view of the spray can actuator of FIG. 27
Figure 29:
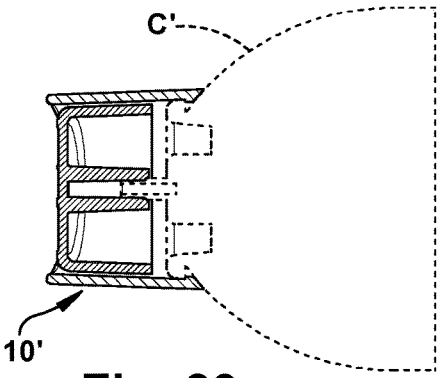
FIG. 29 is a cut-away, partially phantom view of the spray can actuator taken along the line B-B of FIG. 28.
Figure 31:
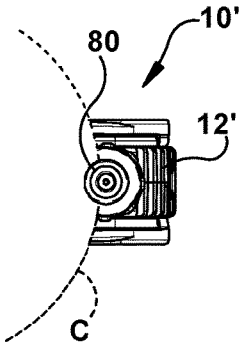
FIG. 31 is a bottom, partially phantom view of the spray can actuator of FIG. 27.
Figure 40:
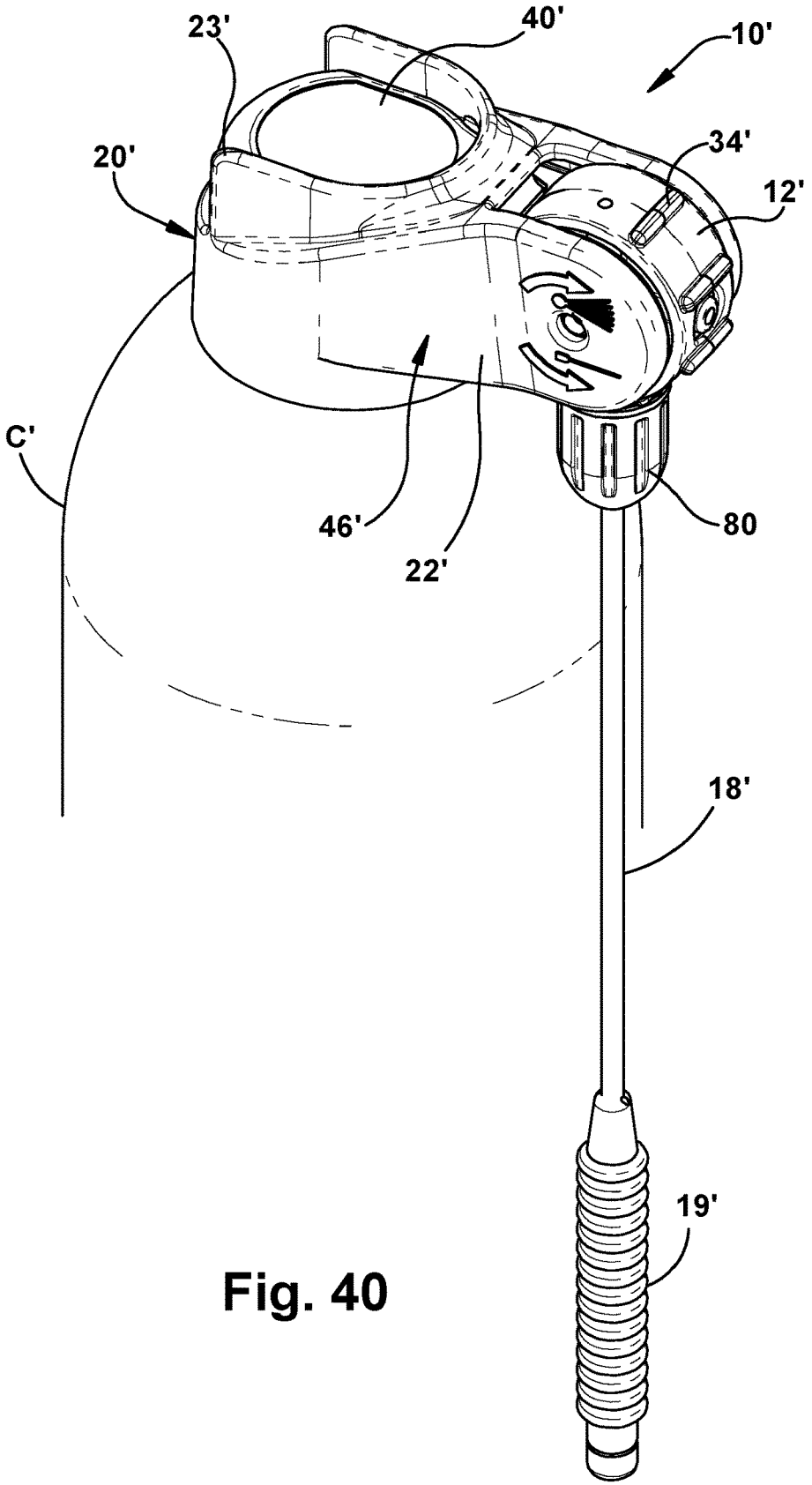
FIG. 40 is a further alternate embodiment of the spray can actuator of this application.

The perspective views of alternate FIGS. 27 and 40 embodiments of the spray can actuator 10' of this application, show the actuator in direct spray/straw down position, and with the external surface of the diverter valve having grooves or raised boss portions, respectively. FIG. 40 of the alternate embodiment of the spray can actuator 10' is in straw up position. To rotate the two-way diverter valve 12' and move the adjustable straw 18 to an operating position, the finger grooves in FIG. 27, or raised boss portions in FIG. 40, are engaged by the user and the diverter valve is rotated in a direction toward the can to move the straw approximately 90 degrees to a horizontal operating position. The rotary diverter valve 12' is rotated supported on axle portions 30' extending from opposing sides of the valve, engaged with axle openings 42' in the mounting legs 22' of the housing 20'. As shown in FIGS. 36 to 39, the diverter valve is positioned to be manually manipulated by the user outside the housing, but is supported within mounting legs extending from the housing. In this position, as shown in Figure Section A-A, an internal cylindrical channel is aligned with the nozzle end of the nozzle passage, to enable fluid communication of product from the valve stem through the diverter valve and out a central passage of the straw 18'.

Figure 30:
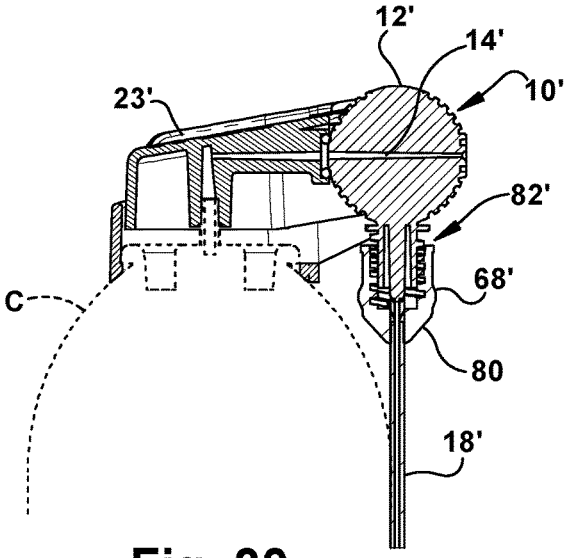
FIG. 30 is a cut-away, partially phantom view of the spray can actuator taken along the line A-A of FIG. 28.
Figure 35:
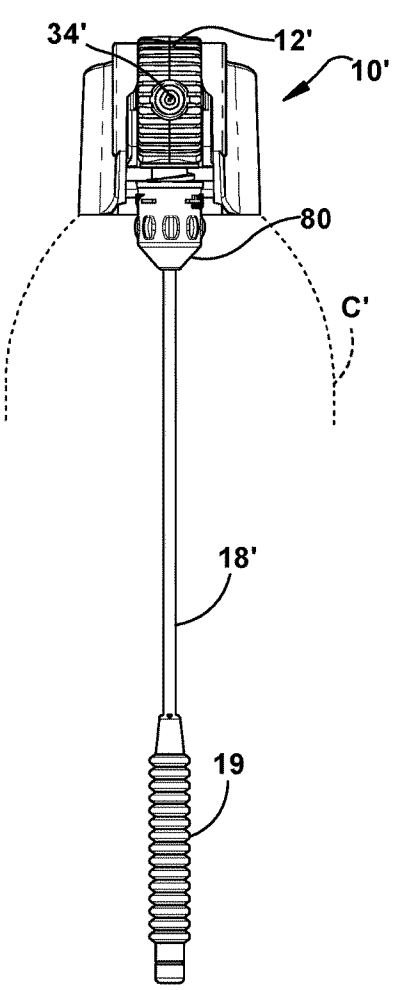
FIG. 35 is a partially phantom, front view of the spray can actuator of FIG. 27.
Figure 34:
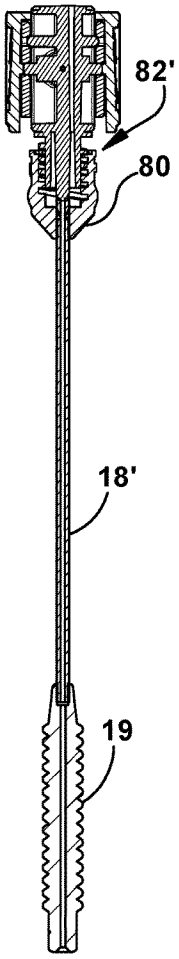
FIG. 34 is a front, cut-away, partially phantom view of the spray can actuator taken along the line C-C of FIG. 33.
Figure 33:
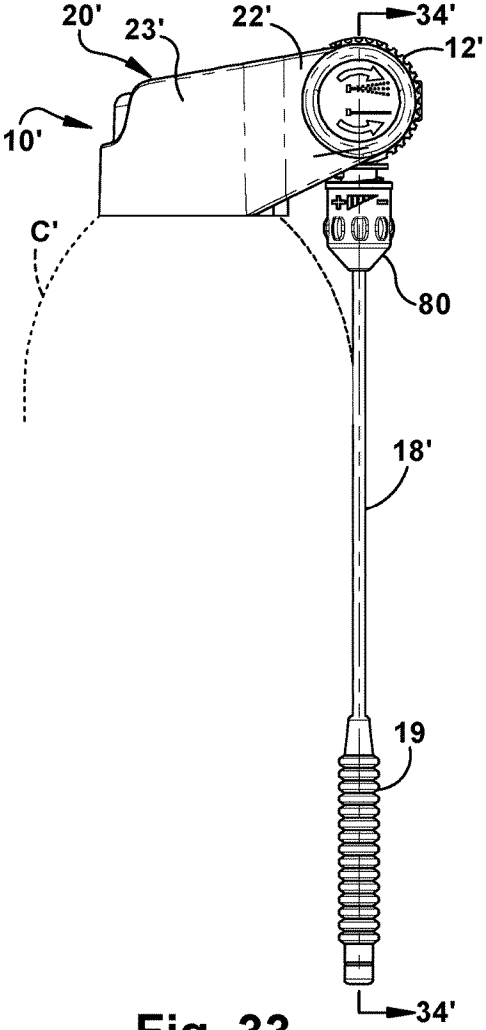
FIG. 33 is a side, partially phantom view of the spray can actuator of FIG. 27.
Figure 32:
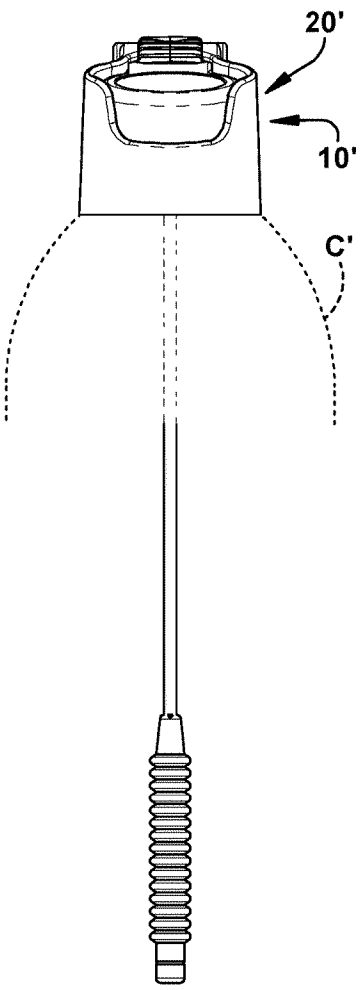
FIG. 32 is a rear, partially phantom view of the spray can actuator of FIG. 27.
Figure 36:
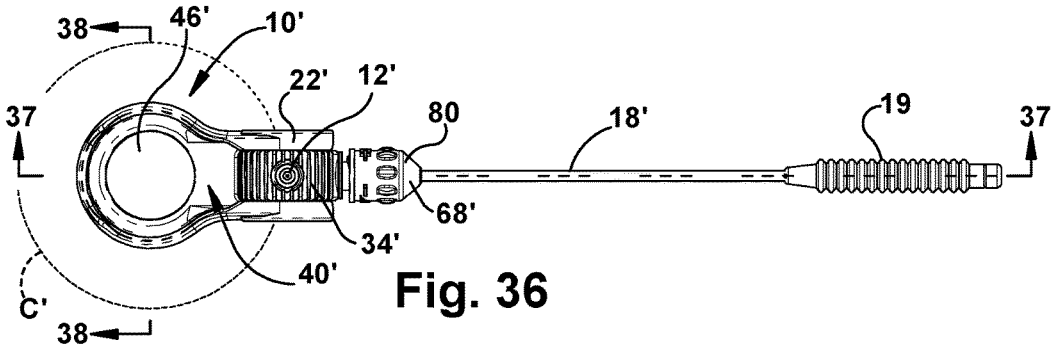
FIG. 36 is a top, partially phantom view of the spray can actuator of FIG. 27 in straw up position.
Figure 37:
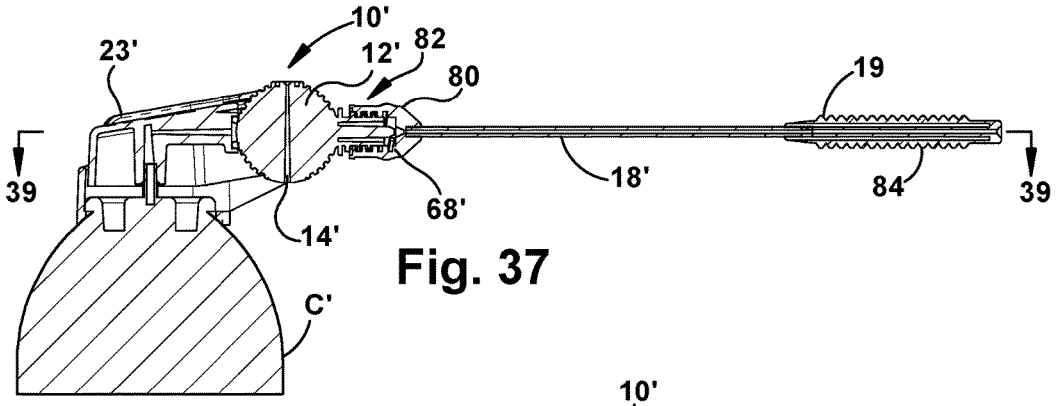
FIG. 37 is a side, cut-away view of the spray can actuator taken along the line D-D of FIG. 36.
Figure 38:
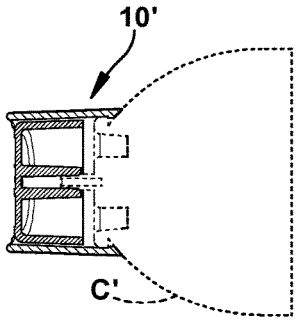
FIG. 38 is a cut-away, partially phantom view of the spray can actuator taken along the line B-B of FIG. 36.
Figure 39:
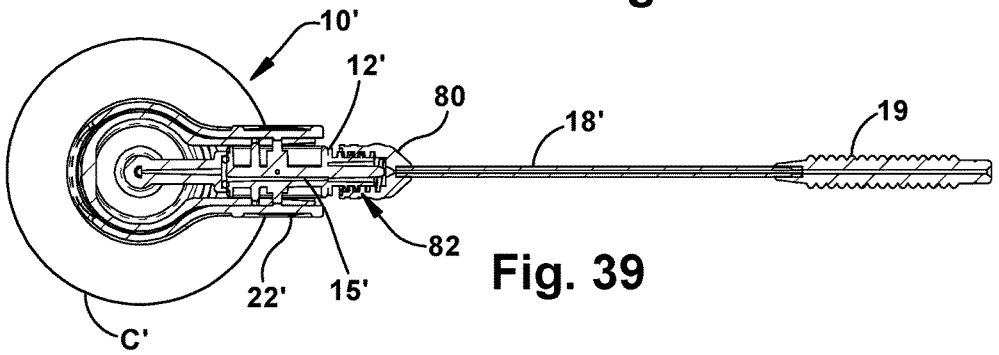
FIG. 39 is a top, cut-away view of the spray can actuator taken along the line 39-39 of FIG. 37.

As shown in FIGS. 30, 33 and 35, the adjustable rotary spray tip 16' is provided with a threaded flow adjustment dial 80, which is engaged with a threaded end 82 of the rotary diverter valve 12'. By rotating the flow adjustment dial 80 along the threaded end 82 of the rotary diverter valve 12', the volume of spray exiting the straw may be adjusted—increased or decreased, as the internal space within the flow adjustment dial is increased or decreased.

The end of the straw 18' includes a flexible tip 19. The flexible tip 19 includes a corrugated external surface, and one or more internal wire members 84 to permit bending of the flexible tip to a desired shape. The internal wire members 84 shown in FIG. 37 maintain the flexible tip 19 bent in the desired shape.

Although the spray can actuator of the present application has been described in detail sufficient for one of ordinary skill in the art to practice the invention, it should be understood that various changes, substitutions and alterations may be made without departing from the spirit or scope of the device as defined in the attached claims. Moreover, the scope of the present device is not intended to be limited to the specific embodiments described here, which are provided by way of example. As one of ordinary skill in the art will readily appreciate from the disclosure of the present device and its embodiments, other components and means presently existing or later to be developed that perform substantially the same function to achieve substantially the same result as those of the corresponding embodiments described here, may be utilized according to the present application. Accordingly, the appended claims are intended to include within their scope such other components or means.

We claim:

1. An actuator for a spray can, the actuator comprising a housing for attachment to a spray can covering a spray can stem valve, a finger operating button structure engaged with the housing for engaging the stem valve, a rotary two-way diverter valve supported within the housing engaged with the finger operating button structure, the two-way diverter valve having a first direct spray nozzle, aligned with a central axis of the two-way diverter valve, and a second nozzle, offset from the central axis of the two-way diverter valve, in communication with an adjustable rotary spray tip secured to the two-way diverter valve, the adjustable rotary spray tip having a straw, and wherein the two-way diverter valve, adjustable rotary spray tip and straw are adapted for directing to a desired, spaced location, in a first position, a desired spray of liquid or, in a second position, desired drops of liquid from the spray can.

2. The actuator for a spray can of claim 1, wherein the finger operating button structure includes a conical nozzle passage for engagement with the stem valve, and a nozzle passage extending horizontally from the conical nozzle passage to a nozzle end, surrounded by a groove for seating an o-ring, and the o-ring engages an external surface of the two-way diverter valve to form a seal.

3. The actuator for a spray can of claim 2, wherein the two-way diverter valve includes boss axles, extending from opposing sides of the diverter valve for captured, rotary engagement of the two-way diverter valve with the finger operating button structure.

4. The actuator for a spray can of claim 3, wherein the two-way diverter valve has raised ribs extending from an external surface.

5. The actuator for a spray can of claim 1, wherein the adjustable rotary spray tip includes raised indicia indicating a drip position and a spray position, and is configured for rotary alignment with respect to the two-way diverter valve to obtain a spray of fluid when rotated into alignment with the spray position raised indicia, and to obtain drops of fluid when rotated into alignment with the drip position raised indicia.

* * * * *